United States Patent [19]

Männle et al.

[11] Patent Number: 4,706,062

[45] Date of Patent: Nov. 10, 1987

[54] POTENTIOMETER

[75] Inventors: Erik Männle, Oberkirch; Peter-Josef Bauer, Bühl, both of Fed. Rep. of Germany

[73] Assignee: Robert Bosch GmbH, Stuttgart, Fed. Rep. of Germany

[21] Appl. No.: 765,432

[22] PCT Filed: Dec. 10, 1984

[86] PCT No.: PCT/DE84/00270

§ 371 Date: Jul. 18, 1985

§ 102(e) Date: Jul. 18, 1985

[87] PCT Pub. No.: WO85/03594

PCT Pub. Date: Aug. 15, 1985

[30] Foreign Application Priority Data

Feb. 4, 1984 [DE] Fed. Rep. of Germany ..... 3403944
May 4, 1984 [DE] Fed. Rep. of Germany ..... 3416495

[51] Int. Cl.[4] ..... H01C 10/36

[52] U.S. Cl. ..... 338/172; 338/171; 338/200

[58] Field of Search ..... 338/198, 171, 172, 162, 338/167, 168, 200; 200/8 R, 8 A, 9, 155 R

[56] References Cited

U.S. PATENT DOCUMENTS

| | | | |
|---|---|---|---|
| 862,842 | 8/1907 | Northrup | 338/171 X |
| 3,863,039 | 1/1975 | Tygard | 200/8 A |
| 4,087,776 | 5/1978 | Donato | 338/198 |
| 4,237,443 | 12/1980 | Gass | 338/171 X |

FOREIGN PATENT DOCUMENTS

| | | | |
|---|---|---|---|
| 0118247 | 9/1984 | European Pat. Off. . | |
| 1134141 | 8/1962 | Fed. Rep. of Germany | 338/171 |
| 2117136 | 10/1983 | United Kingdom . | |

OTHER PUBLICATIONS

M.T.Z., Motortechnische Zeitschrift, Band 42, No. 12, Schwäbisch-Gmünd (DE) "Elektronisches Gas Pedal von Bosch", Dec. 1981, p. 528.

"Printed Potentiometer Technology has Wider Design Potential", Eureka, (Nov. 1983) p. 5.

*Primary Examiner*—Elliott Goldberg
*Assistant Examiner*—M. M. Lateef
*Attorney, Agent, or Firm*—Michael J. Striker

[57] ABSTRACT

In a potentiometer, wherein switching functions are triggered in association with the potentiometer position electrical switches (21–24) are mounted on the potentiometer plate (1) which supports the collector path (11) for the purpose of the very accurate association of the switching operations with respect to the potentiometer position and with spatially fixed switch on and switch off points with respect to the collector path (11). The switch elements which effect the switching on and off are mounted ona potentiometer setting member (17) electrically insulated which supports the customary potentiometer slider (19,20). Advantageously, each switch (21–24) is formed by a contact path (25–28) and a contact finger (29,30) rotating and sliding over the associated contact path (25,28), whereby the contact finger is mechanically connected with the potentiometer member (17). The beginning and the end of the contact paths (25–28) define the switching on and off point of each switch (21–24) (FIG. 1).

12 Claims, 6 Drawing Figures

POTENTIOMETER

BACKGROUND OF THE INVENTION

The invention relates to a potentiometer, in particular for an electrical gas pedal in motor vehicles.

In so-called electrical gas pedals such potentiometer serve to control a servo-motor which controls the fuel-air mixture being supplied to the internal combustion engine or the vehicle motor, like when actuating the otherwise customary gas pedal. The servo-motor is controlled corresponding to the control voltage picked off from the potentiometer, thus effecting an increase or reduction of the speed in the internal combustion engine.

In many cases, in particular in a motor vehicle with such an electrical gas pedal it is required to actuate electrical switches for triggering certain functions in dependency from the control voltage being fed to the servo-motor, for example, in the internal combustion engine of a motor vehicle an idle switch, safety switch, full load switch, kick-down switch, throttle valve switch and other switches, for example, for the gas pump, ignition etc., as well as a plurality of control switches. Hitherto, such switch functions were performed by so-called micro switches which are switched on or off through the potentiometer. The assembly effort required for the microswitches to be installed separately from the potentiometer is considerable. Furthermore considerable tolerances in the association from the time switching point and the control voltage picked off from the potentiometer are generated.

ADVANTAGES OF THE INVENTION

In contrast thereto the potentiometer in accordance with the invention is advantageous in its structure and cost efficient in manufacturing. The switch time points may be associated highly accurately and with very small manufacturing tolerances of the potentiometer position and the picked off control voltages. The potentiometer and the switches are robust, less susceptible to interference and therefore suitable for a rough operation and also have a relatively long life span.

BRIEF DESCRIPTION OF THE DRAWING

The invention is explained in more detail in conjunction with one exemplified embodiment illustrated in the drawing and in the following description.

DESCRIPTION OF THE PREFERRED EMBODIMENTS

Figure 1:
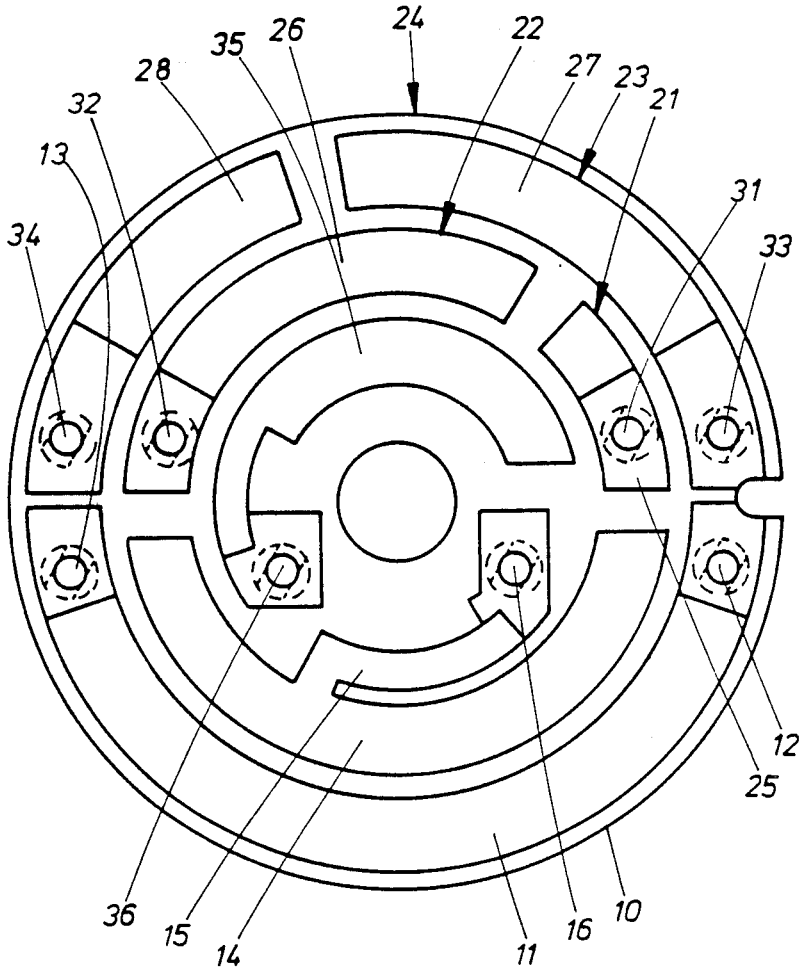
FIG. 1 is a plan view of a potentiometer plate of a rotating potentiometer with switches, FIG. 2 a plan view of a potentiometer setting member for use with the potentiometer plate in FIG. 1.
Figure 2:
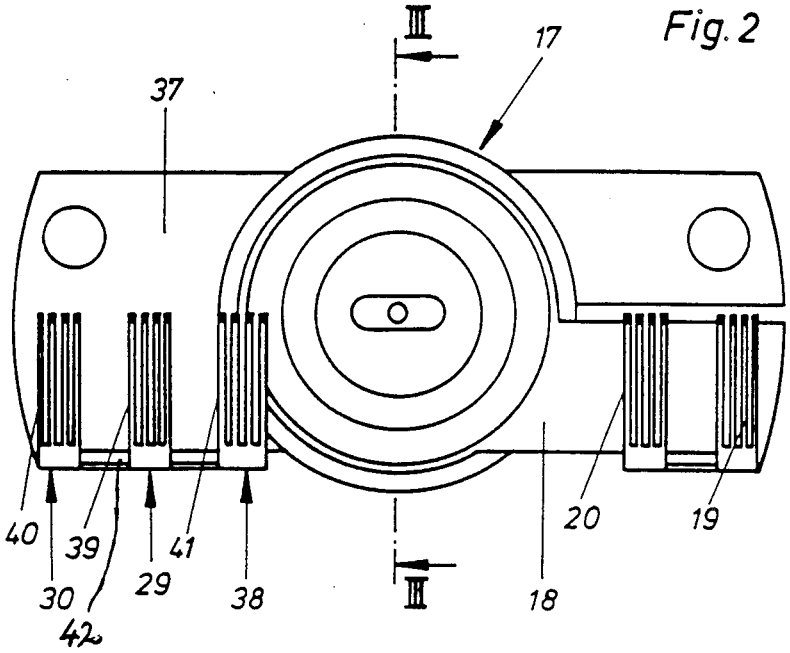
Figure 3:
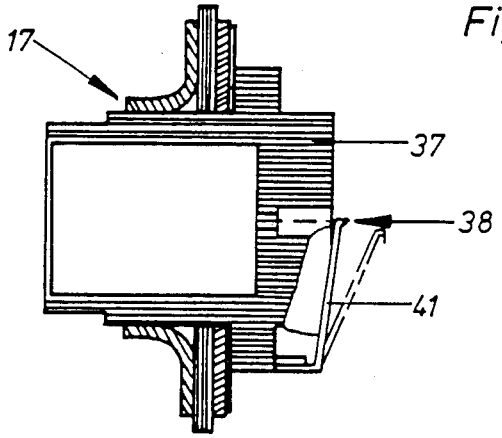
FIG. 3 is a section along line III—III in FIG. 2, FIG. 4 a way-step-diagram of the rotating potentiometer with switches in accordance with FIGS. 1–3, FIG. 5 a schematic side view of a potentiometer in accordance with a second exemplified embodiment, FIG. 6 a plan view of the potentiometer plate of the potentiometer in FIG. 5.

The potentiometer for an electrical gas pedal in a motor vehicle illustrated in its individual parts in FIGS. 1–3 is designed as a rotating potentiometer. It is provided with a circular disc like potentiometer plate 10 as illustrated in plan view in FIG. 1, on which a collector path 11 is provided designed as a resistor path. The semi-circular curve shaped collector path 11 is mounted on one half of the disc of the potentiometer plate 10 and extends over an angle of about 180°. The collector path 11 is provided with connecting contacts 12,13 disposed at both ends thereof and each designed as a bore into which the connecting cable can be plugged in from the rear side of the potentiometer plate 10. A semi-circular shaped sliding path 14 extending parallel, e.i., concentric to the collector path 11, is connected with a connecting contact 16 by means of a connecting lug 15 mounted on potentiometer plate 10.

Figure 4:
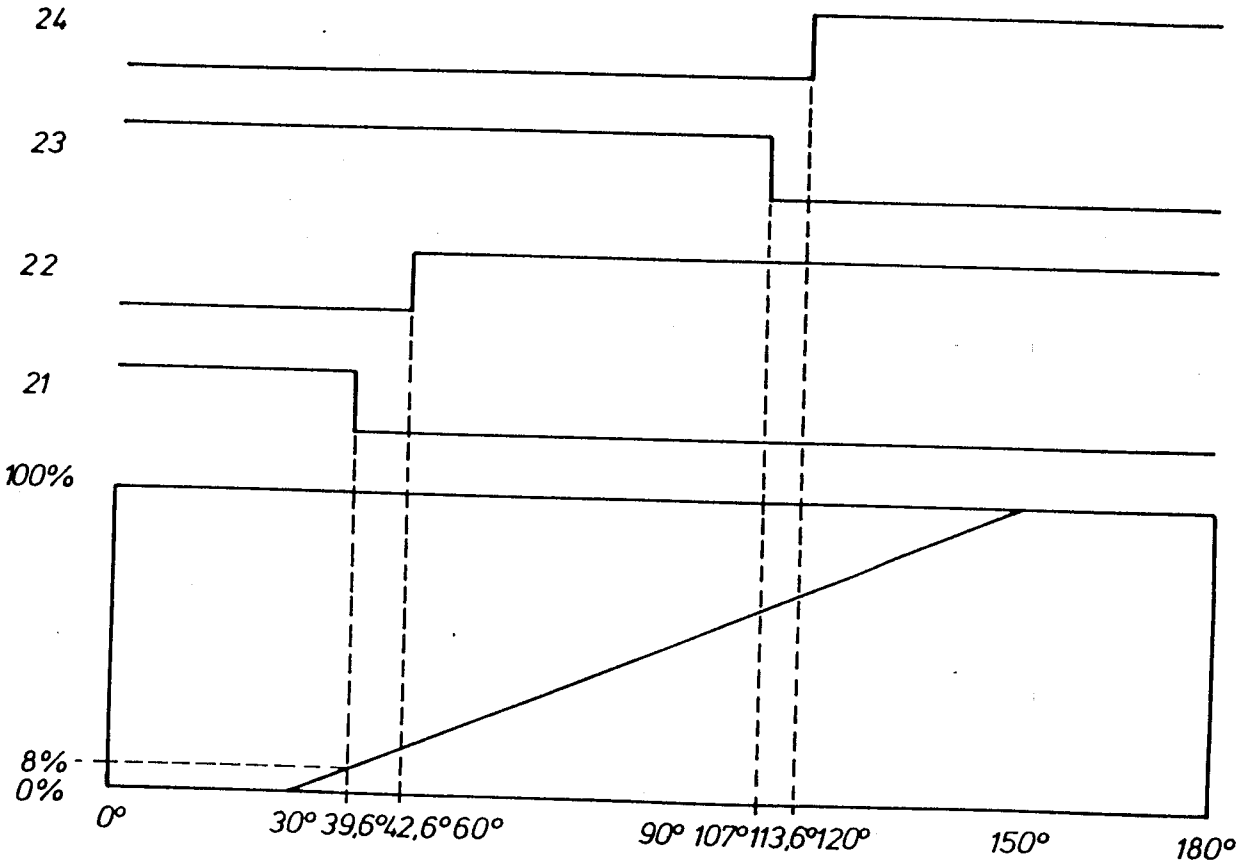

A potentiometer setting member 17 illustrated in a plan view in FIG. 2 and in a sectional view in FIG. 3 supports an arm 18 on which two contact spring assemblies 19,20 which are electrically connected with each other are mounted. One contact spring assembly 19 or 20 slidingly engages the sliding path 11 or sliding path 14 in the assembled state of the potentiometer. The two contact spring assemblies 19 and 20 form the slider or potentiometer pick up of the potentiometer which picks up a part of the voltage drop between the connecting contacts 12 and 13 on the collector path 11 as a control voltage which can be picked up on the connecting contact 16 of the sliding path 14. The control voltage which is picked up from slider 19, 20 through the potentiometer setting member 17 is illustrated below in FIG. 4. One can see that the control voltage remains at zero up to an adjustment angle 30°, then it increases linearly with the rotating angle and finally reaches the maximum amount at a rotating angle of 150° which is maintained up to a rotating angle of 180°.

The other disc half of the potentiometer plate 10 represents a switch disc on which four electrical switches 21,22,23,24 are disposed with switch on and switch off points which are spatially fixed with respect to the collector path 11. The switch on and switch off points of switches 21–24 in relationship to the rotating angle of the potentiometer are illustrated in the step-diagram of FIG. 4. The switch elements which effect the switching on and switching off are mounted on the potentiometer setting member 17 electrically insulated, as will be described later.

Each switch 21–24 is provided with a contact path 25,26,27,28 mounted on the potentiometer plate 10, whose beginning and end define the switching on and switching off point of switches 21–24. Furthermore, each switch 21–24 is provided with a contact finger 29,30 which is mechanically connected with the potentiometer setting member 17 and can be rotated over the contact path, whereby it is slidingly engaging thereon. Since the two switches 21 and 22 and the two switches 23 and 24 do not close in an overlapping manner in time successively alternately, their contact paths 25,26 or 27,28 are disposed successively at a distance with respect to each other and substantially flush, so that the contact paths 25,26 or 27,28 are disposed on two concentric semi-circular curves with respect to each other. Only one contact finger 29 or 30 (FIG. 2) are required for the successively disposed contact paths 25,26 or 27,28. Each contact path 25–28 has a connecting point 31–34 which are formed as bore holes for a rear side plugging in of connecting cables as in collector path 11. Concentrically to the four contact paths 25–28 and with respect to the axis of the potentiometer plate 10 a counter potential path 35 is disposed on the latter and connected with a connecting contact 36.

The potentiometer setting member 17 supports a second arm 37 diametrically disposed to the first arm and carrying two contact fingers 29,30 and a further contact finger 38 which is yieldingly mounted on the counter potential path 35 in each rotating position of the potentiometer setting member 17. The contact finger 38 together with each of the contact fingers 29,30 form a contact bridge connecting the counter potential path 35 with the contact paths 25,26 or 27,28. thus representing the switch element of switches 21–24. Each of the contact fingers 29,30,38 is designed as a contact spring assembly 39,40,41. The contact spring assemblies 39,40,41 are mounted in an insulated manner on arm 37 and are electrically connected with each other by a rib 42.

The contact paths 25–28 may be made in the same manner as the collector path 11, that is, with the usual processes used in the potentiometer technology. For higher outputs it is advantageous to design the contact paths as metal plates which are inserted into the potentiometer plate 10.

Figure 5:
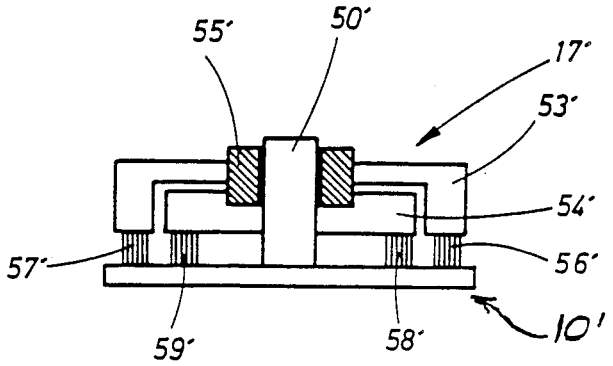
Figure 6:
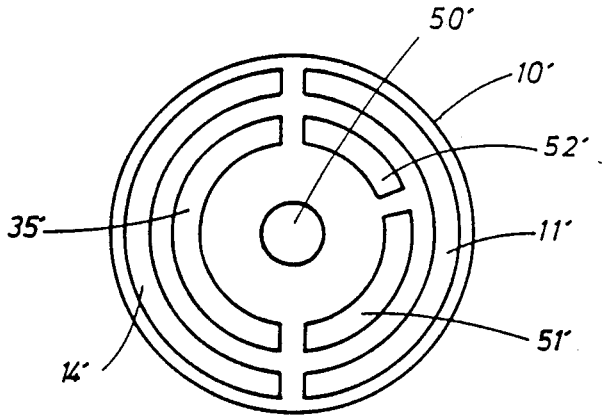

The potentiometer schematically illustrated in FIGS. 5 and 6 is identical with the described potentiometer in its mode of operation and is only somewhat modified in its structure. As far as the structural parts are identical, they are characterized with the same reference numeral provided with a prime sign.

Again, the potentiometer plate 10' is designed as a circular disc (FIG. 6) and the potential setting member 17' is designed as a rotating member which is rotatable around a pin 50' centrally mounted on the potentiometer plate 10' (FIG. 5)

In contrast to the exemplified embodiment in accordance with FIGS. 1–3, the contact paths 51' and 52' and the collector path 11' are mounted on the same half of the potentiometer plate 10' and the counter contact path 35' and the sliding path 14' which is electrically associated with the collector path 11' are mounted on the other disc half. Again, the successively flush disposed contact paths 51' and 52' of two successive actuated switches are again mounted on a semi-circular curve which extends concentrically to the collector path 11'. Thereby, the contact path 11' and the collector paths 51',52' are disposed in a very tight spatial relationship with each other.

This arrangement of contact paths 51',52' and collector path 11' has the advantage that the potentiometer does not have to be highly accurately made or subsequently adjusted, so as to obtain an accurate association of the voltage dividing relationship, that is, the voltage picked off from the potentiometer in the relationship to the total voltage and switching time point of the switches formed by the contact paths 51' and 52'. A low excentricity of the potentiometer setting member 17' with respect to the potentiometer plate 10 within relatively arge manufacturing tolerances, which is caused by the excentricity of the rotating point or due to the tolerance of the contact pressure height of the rotating member does not result in no change or only a slow still permissible change of the voltage dividing ratio in the given switching time point, e.g., at the time of the reaction of the switches. Thereby, the switches are already associated correctly with respect to a defined rotating angular position of the potentiometer setting member 17' and thereby results in a reliable accurate voltage divider ratio.

The potentiometer setting member 17' which is designed as a rotating member is provided with two rotating yokes 53' and 54' which are stationary connected with each other. The two rotating yokes 53' and 54' are mounted on a retaining ring 55' which glides on pin 50' electrically insulated from each other, so that they rotate synchronously with respect to each other. The rotating yoke 53' is provided with two electrically connected, diametrically disposed slidingly spring assemblies 56',57' which yieldingly engage the associated conduct paths, namely on the collector path 11' and the sliding path 14'. The other rotating yoke 54' also supports identically shaped sliding spring assemblies 58' and 59' which slide on contact paths 51' and 52' or on the counter potential path 35'.

In this embodiment of the potentiometer switches may be provided which open and close timely overlapping. For this purpose, one or a plurality of contact paths have to be provided which should be disposed as semicircular curves with respect to the collector path 11'. In the interest of a possible very small excentricity error, parallel contact paths are advantageously provided on both sides of the collector path 11' and possibly very close thereto. The rotating yoke 54' will receive a further slide sping assembly which engages the further parallel concentric contact paths.

The invention is not limited to the aforedescribed exemplified embodiment of a rotational potentiometer. In the same manner the potentiometer may be designed as a slide potentiometer, wherein the collector path and the contact paths are mounted adjacent to each other. Contact paths which are disposed chronically successively and chronically not overlapping when closing the switches are disposed in the same manner along the the displacement path of the potentiometer setting member successively flush with respect to each other. The collector path and the contact paths may also be disposed on different sides of the potentiometer plate.

Furthermore, it is not required that the switch elements of the switches 21–24, that is, the contact fingers 29,30 formed by the contact spring assemblies 39,40 are mounted electrically insulating on the potentiometer setting member 17. Moreover, the potentiometer voltage may be used for generating a switch signal, in that the contact finger 29, 30 are electrically conductively connected with the contact spring assemblies 19,20 which form the slider. In this case, the counter contact path 35 on the potentiometer plate 10 and the associated contact finger 38 on the arm 37 may be discarded.

We claim:

1. A potentiometer, in particular for an electrical gas pedal in motor vehicles, comprising, a potentiometer plate provided with at least one collector path formed as a resistor path and at least one sliding path which extends over the length of said collector path, and also provided with a plurality of contact paths spaced from said collector path and each having a beginning and an end which define switch-on and switch-off points, said contact paths being arranged concentrically relative to one another; and a mechanically actuatable potentiometer setting member having a slider engaged with said sliding path and said collector path so as to slide on said collector path and to pick up an electric control voltage, said potentiometer setting member also having contact fingers arranged concentrically relative to one another and fixedly connected with said potentiometer setting member so as to rotate together with the latter in sliding engagement with a respective one of said contact paths, said contact paths of said potentiometer plate and said contact fingers of said potentiometer setting member together forming electrical switches.

2. A potentiometer as defined in claim 1, wherein each of said contact paths is provided with one connecting contact, said contact paths being arranged successively on said potentiometer plate over a predetermined length, said potentiometer plate further comprising a counter potential path provided with a connecting contact and extending over the total length of said contact paths, said potentiometer setting member having a further contact finger slidingly engaging said counter potential path, each of said contact fingers forming a contact bridge with said further contact finger so as to connect a respective one of said contact paths with said counter potential path.

3. A potentiometer as defined in claim 1, wherein said contact paths are formed as metal plates which are inserted in said potentiometer plate.

4. A potentiometer as defined in claim 2, wherein said potentiometer plate is formed as a circular disc having a central axis, said potentiometer setting member being formed as a rotatable member which rotates around said central axis of said potentiometer plate.

5. A potentiometer as defined in claim 4, wherein said collector path extends over one half of said disc, said contact paths extending over the other half of said disc over an angle of approximately 180°.

6. A potentiometer as defined in claim 2, wherein said contact paths and said counter potential path are arranged concentrically relative to one another, said potentiometer setting member having an arm provided with contact bridges which are formed by electrically connected slide spring assemblies extending transversely to said paths and sliding on a respective one of said paths.

7. A potentiometer as defined in claim 1, wherein said potentiometer plate is formed as a circular disc, said collector path extending substantially semi-circularly for a predetermined length and has two ends each provided with a connecting contact, said sliding path having a further connecting contact.

8. A potentiometer as defined in claim 7, wherein said potentiometer plate also has a counter potential path, said contact paths and said collector path being arranged on disc half of said circular disc, while said counter potential path and said sliding path are arranged on the other half of said circular disc of said potentiometer plate, said contact paths extend flush successive in form of a semi-circular curve which is concentrical to said collector path at a small distance therefrom.

9. A potentiometer as defined in claim 8, wherein said contact paths are arranged at both sides of said collector path.

10. A potentiometer as defined in claim 8, wherein said potentiometer setting member has two electrically insulating rotating yokes which are stationarily connected with one another and arranged so that one of said rotating yokes carries two electrically connected diametrically opposite slide spring assemblies which yieldingly engage said collector path and said sliding path, while the other of said rotating yokes supports uniform electrically connected slide spring assemblies which engage said counter potential path and each abut against a respective one of said contact paths.

11. A potentiometer as defined in claim 1, wherein said potentiometer plate has a rear side, said connecting contacts being formed as bores which are accessible from said rear side of said potentiometer plate.

12. A potentiometer as defined in claim 1, wherein said contact paths of said electrical switches are arranged in an overlapping manner.

* * * * *